US007601017B2

(12) United States Patent
Wang et al.

(10) Patent No.: US 7,601,017 B2
(45) Date of Patent: Oct. 13, 2009

(54) ELECTRICAL CONNECTOR FOR SECURING A FLEXIBLE FLAT CABLE

(75) Inventors: Chien Chun Wang, Taoyuan (TW); Chih-Ping Chung, Taoyuan (TW)

(73) Assignee: P-Two Industries, Inc., Taoyuan (TW)

( * ) Notice: Subject to any disclaimer, the term of this patent is extended or adjusted under 35 U.S.C. 154(b) by 0 days.

(21) Appl. No.: 12/171,285

(22) Filed: Jul. 10, 2008

(65) Prior Publication Data

US 2009/0181573 A1 Jul. 16, 2009

(30) Foreign Application Priority Data

Jan. 14, 2008 (TW) ..... 97101447 A

(51) Int. Cl.
*H01R 13/15* (2006.01)

(52) U.S. Cl. ..... 439/260; 439/495

(58) Field of Classification Search ..... 439/260, 439/494, 495

See application file for complete search history.

(56) References Cited

U.S. PATENT DOCUMENTS

| | | | | |
|---|---|---|---|---|
| 7,086,893 | B2 * | 8/2006 | Liu et al. | 439/495 |
| 7,361,042 | B2 * | 4/2008 | Hashimoto et al. | 439/260 |
| 2007/0032115 | A1 * | 2/2007 | Takashita | 439/260 |
| 2007/0049087 | A1 * | 3/2007 | Hashimoto et al. | 439/260 |

* cited by examiner

*Primary Examiner*—Tho D Ta
(74) *Attorney, Agent, or Firm*—Egbert Law Offices PLLC

(57) ABSTRACT

The present invention relates to an electrical connector for fastening a flexible flat cable. The electrical connector includes an insulating body, a plurality of terminals, a pair of shims and a flip cover. The flip cover has rotatable portions pivotally disposed within the guiding grooves of the terminals, which enable the flip cover to rotate between a position for an open loop and a position for a closed loop. When the flip cover is in the position for an open loop, the rotatable portions are embedded into the guiding grooves. When the flip cover is in the position for a closed loop, the rotatable portions are propped against the upper arms and the lower arms simultaneously such that the upper contact portions are propped downwards tightly against the flexible flat cable to securely hold and position the flexible flat cable.

10 Claims, 5 Drawing Sheets

ELECTRICAL CONNECTOR FOR SECURING A FLEXIBLE FLAT CABLE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an electrical connector, and more particularly to an electrical connector for the insertion of a flexible flat cable, being capable of securely holding the flexible flat cable.

2. Description of Related Art Including Information Disclosed Under 37 CFR 1.97 and 37 CFR 1.98.

A common flexible flat cable (FFC) is a product including a signal line wrapped in a plastic insulating film, whose most important characteristics are its flexibility, light weight and small thickness. It can be adapted to the size and shape of the internal space of an electronic product for a three dimensional arrangement of lines, and is suitable for a wide variety of light, thin and compact electronic products, such as notebook computers, CD-ROM drives, disk drives, printers or mobile phones, or the like. The flexible flat cable itself is not directly connected to a circuit board but electrically connected with the circuit board through a connector, which is fastened thereon, during use. Such a connector is generally referred to as a flexible flat cable connector.

A conventional flexible flat cable connector is illustrated in Taiwan, R.O.C. Patent Application No. 095124194. The structure comprises a housing made of insulating material, a plurality of terminals, and a movable member. The terminals are assembled within the housing, and each terminal has a pressing portion for pressing the flexible flat cable. A pressure receiving portion is provided at the other end opposite to the pressing portion. When the movable member moves toward a position for a closed loop, the movable member applies a pressure to the pressure receiving portion such that the terminal will elastically deform to enable the pressing portion to pressurize the flexible flat cable, thereby providing an electrical connection.

However, the pressure receiving portion of the above terminal has a projecting portion and a recessed portion linked with the projecting portion, such that when the movable member rotates until its cam portion is propped against the projecting portion, the cam portion can apply the maximum propping force to exactly and tightly prop the flexible flat cable. Then, the cam portion rotates into and is positioned in the recessed portion. As a result, when the movable member rotates into and is positioned in the recessed portion, the movable member is not propped against the projecting portion. Therefore, the maximum propping force is not exerted by the pressing portion so it fails to securely prop the flexible flat cable. Furthermore, due to the small area of the projecting portion, the cam portion of the movable member cannot be exactly propped against the projecting portion. This results in the difficulty of a maximum propping force exerted by the pressing portion so it fails to exactly and tightly prop the flexible flat cable, thus causing the disengagement of the flexible flat cable due to its loosening.

Therefore, to seek possible improvement on the above problem, the inventors have devoted in the research and finally have come up with an invention with effective improvement on the above shortcomings according to their related experience and observations for many years and combining with the theoretical application.

BRIEF SUMMARY OF THE INVENTION

The objective of the present invention is to provide an electrical connector, which utilizes its structural features of terminals and a flip cover and the relative positions thereof to enable the upper contact portions of the terminals to be propped tightly against the surface of a flexible flat cable more securely, thus making the electrical transmission more smooth and stable.

The objective of the present invention is to provide an electrical connector, which utilizes the relative positions between the upper contact portions and the lower contact portions of the terminals to hold a flexible flat cable more securely and to avoid the disengagement of the flexible flat cable.

The present invention relates to an electrical connector for fastening a flexible flat cable, comprising an insulating body, a plurality of terminals, a pair of shims and a flip cover. The insulating body has a front opening and a rear opening that pass through the insulating body, and a plurality of terminal sockets. The terminals are accommodated within the terminal sockets, and each terminal has an upper arm and a lower arm disposed parallel to each other. The upper arm and the lower arm each have an upper contact portion and a lower contact portion formed on its front end. The upper arm has a guiding groove disposed at its rear end. The pair of shims are assembled at the two sides of the insulating body, and the two sides of the flip cover have shaft portions placed on the shims. The flip cover has rotatable portions pivotally disposed within the guiding grooves, which enable the flip cover to rotate between a position for an open loop and a position for a closed loop. When the flip cover is in the position for an open loop, the rotatable portions are embedded into the guiding grooves. When the flip cover is in the position for a closed loop, the rotatable portions are propped against the upper arms and the lower arms simultaneously such that the upper contact portions are propped downwards tightly against the flexible flat cable to securely hold and position the flexible flat cable.

The technical means to achieve these objects and the effects of the invention will be more apparent from the following detailed description with reference to the accompanying drawings that show some preferred embodiments thereof only by way of a not limiting example.

DETAILED DESCRIPTION OF THE INVENTION

Figure 1:
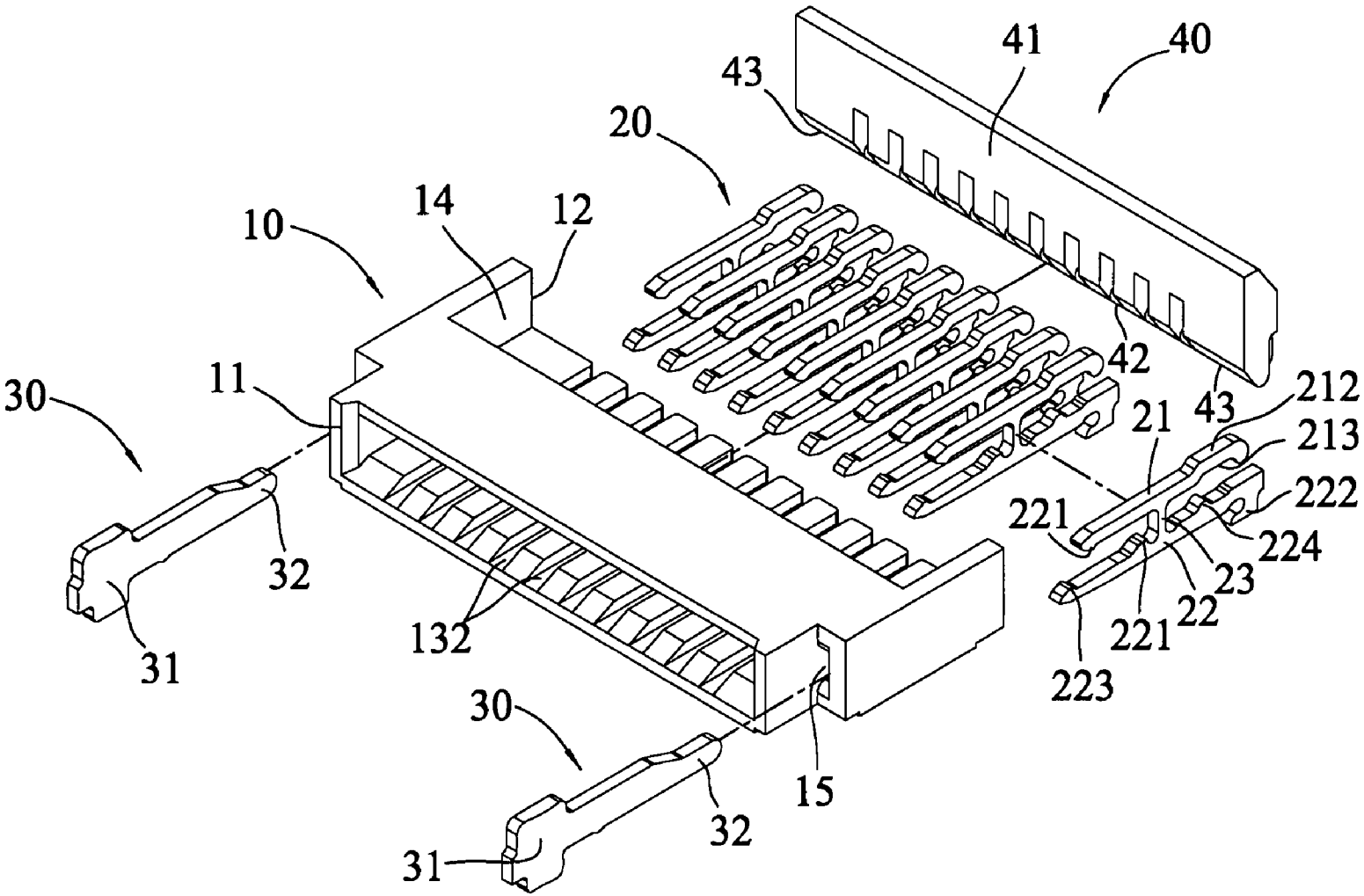
FIG. 1 is an exploded perspective view of the present invention.
Figure 2:
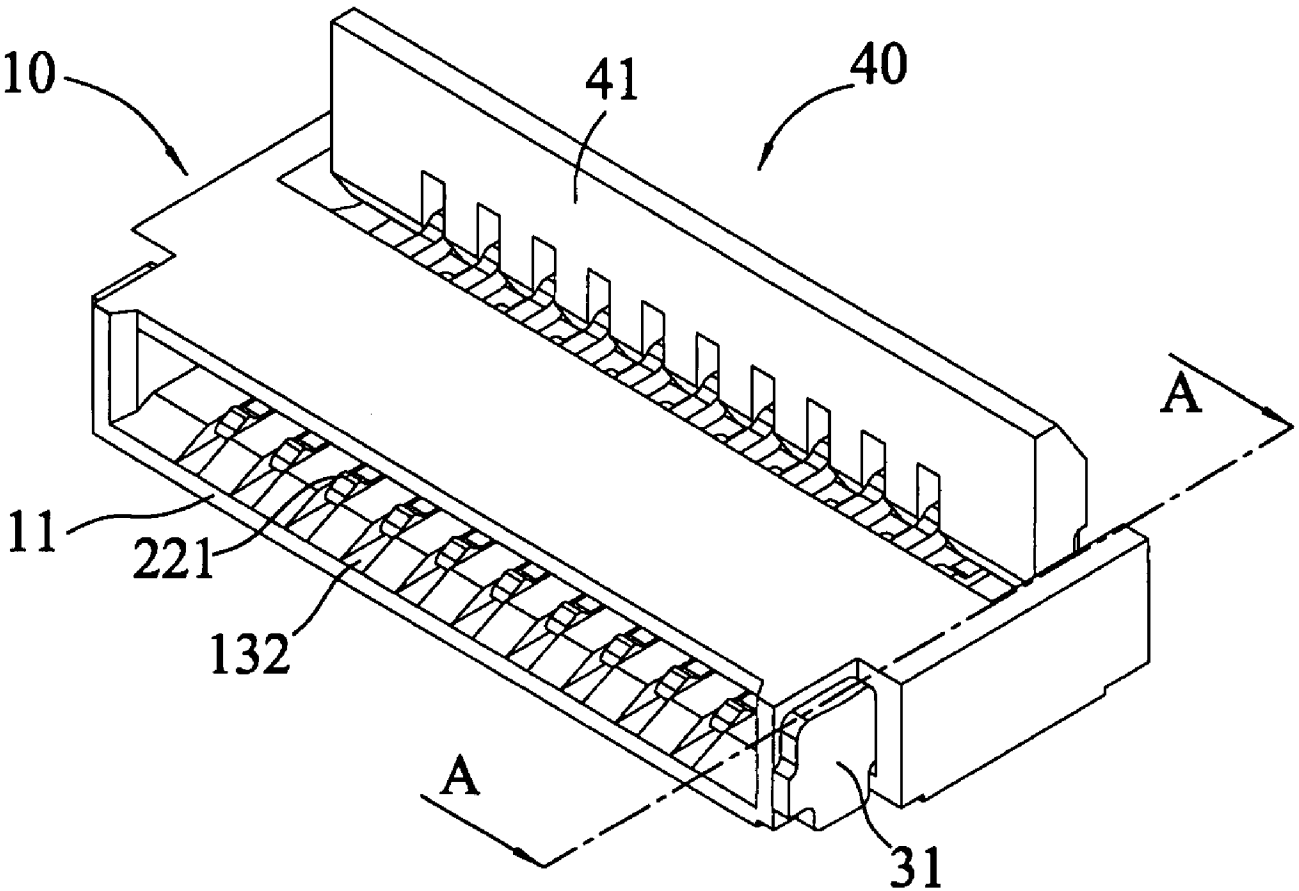
FIG. 2 is a perspective view of the assembly of the present invention.

Referring to FIGS. 1 to 4, there are the three dimensional exploded perspective view, the three dimensional perspective view of the assembly, and the cross-sectional side view showing the complete assembly and the cross-sectional side view taken along the A-A line segment of FIG. 2 of the preferred embodiment according to the present invention. As shown in these drawings, the electrical connector of the present invention comprises an insulating body 10, a plurality of terminals 20, a pair of shims 30 and a flip cover 40. The structure of each component is described herein.

The insulating body 10 is substantially a rectangular body. The insulating body 10 has a front opening 11 and a rear opening 12 that pass through the insulating body 10, and a plurality of transversely arranged terminal sockets 13. The terminal socket 13 consists of an upper slot 131 and a lower slot 132 which are correspondingly arranged. A positioning portion 133 is disposed between the upper socket 131 and the lower socket 132, and a hollowed out cavity 14 is disposed on the top surface of the insulating body 10 adjacent to the rear opening 12, and the two sides of the insulating body 10 are provided with through notches 15 that also pass through the insulating body 10. The through notches 15 are used for the mounting of the shims 30.

The terminal 20 is stamped and formed from a single piece of sheet metal, and each terminal 20 is double T-shaped so as to have an upper arm 21 and a lower arm 22 disposed parallel to each other. The upper arm 21 and the lower arm 22 are provided therebetween with a linking portion 23 vertical to the upper arm 21 and the lower arm 22. The upper arm 21 and the lower arm 22 each have an upper contact portion 211 and a lower contact portion 221 formed on its front end, and the upper arm 21 is formed on its rear end with a pivoting portion 212 that has a guiding groove 213. The end of the lower arm extends downwardly and forms a soldering portion 222 which can be soldered and fixed on a circuit board (not shown). Also, the lower arm 22 is provided with a protruding portion 223 corresponding to the positioning portion 133 and with a stop shoulder 224 corresponding to the front end of the guiding groove 213.

The shim 30 is stamped and formed from a single piece of sheet metal. The shim 30 has a propping portion 31 disposed at its front end, and the shim 30 is provided at its rear end with a flat plate portion 32 having a height less than the height of the propping portion 31.

Figure 3:
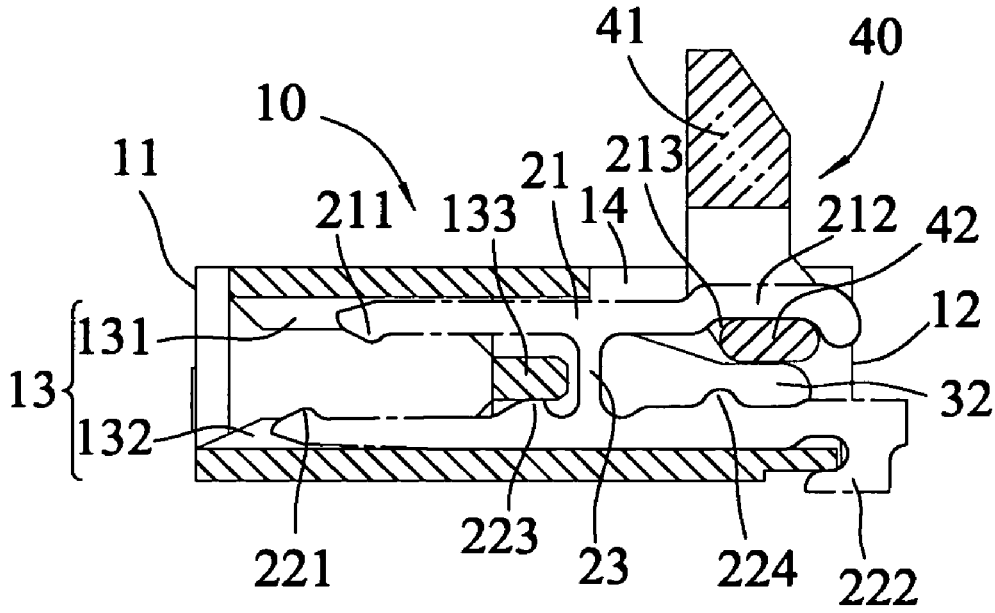
FIG. 3 is a cross-sectional side view showing the complete assembly of the present invention.
Figure 4:
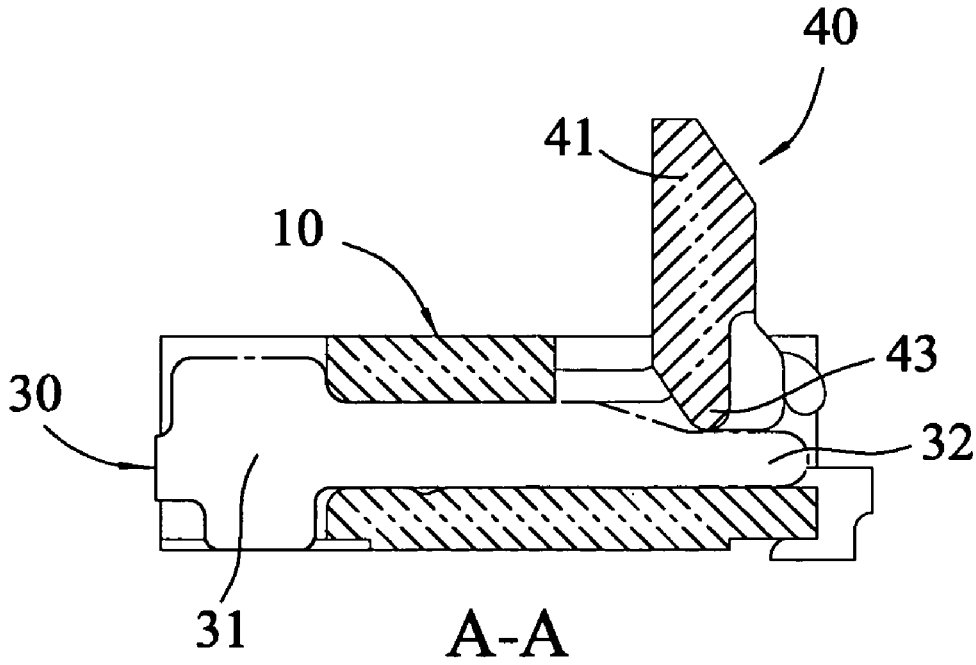
FIG. 4 is a cross-sectional side view taken along the A-A line segment of FIG. 2 according to the present invention.

The flip cover 40 is made of an insulating material, which has an operating portion 41 and rotatable portions 42, and the rotatable portions 42 are formed at their two sides with shaft portions 43. Also, the rotatable portions 42 of the flip cover 40 are arranged corresponding to the guiding grooves 213 of the terminals 20 to enable the rotatable portions 42 arranged at equal intervals. The rotatable portion 42 has an elongated circular cross section (as shown in FIG. 3).

In assembling the above structure, first of all, the terminals 20 are assembled from the rear opening 12 into the terminal sockets 13, and the soldering portions 222 of the terminals 20 are propped against the outer edge of the rear opening 12 and extend beyond the rear opening 12. The upper arms 21 and the lower arms 22 are positioned within the upper slots 131 and the lower slots 132 respectively. The protruding portions 223 of the lower arm 22 interfere with the positioning portions 133 to securely position the terminals 20, followed by assembling the shims 30. The shims 30 are inserted from the front of the insulating body 10 into the through notches 15 to enable the propping portions 31 of the shims 30 to wedge against the front end portions of the openings of through notches 15 for positioning. The flat plate portions 32 of the shims 30 extend beyond the through notches 15 and outward below the hollowed out cavity 14. At last, the flip cover 40 is assembled. The rotatable portions 42 of the flip cover 40 are assembled within the guiding grooves 213 of the pivoting portions 212 of the upper arms 21 such that the rotatable portions 42 interfere with the guiding grooves 213, and the shaft portions 43 disposed on the two sides of the flip cover 40 are steadily placed on the flat plate portions 32 to avoid vibration and improve stability of the flip cover 40. This also enables the flip cover 40 to rotate between a position for an open loop and a position for a closed loop. After the flip cover 40 is assembled, the arrangement of the stop shoulders 224 on the lower arms 22 enables the stop shoulders 224 to stop in front of the rotatable portions 42 so as to prevent the flip cover 40 from slipping inwardly.

Figure 5:
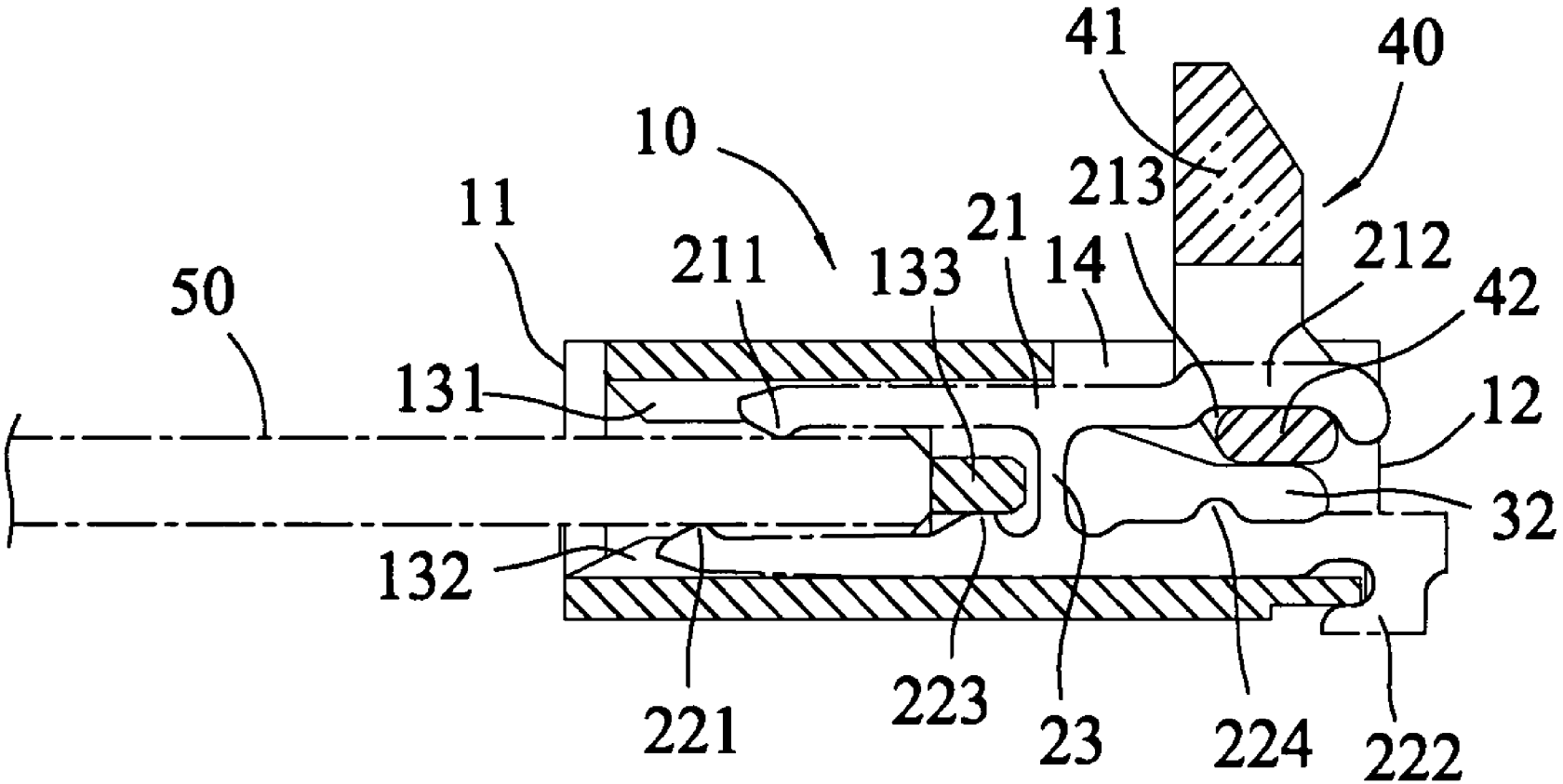
FIG. 5 is a schematic cross-sectional view of the present invention in an open state.
Figure 6:
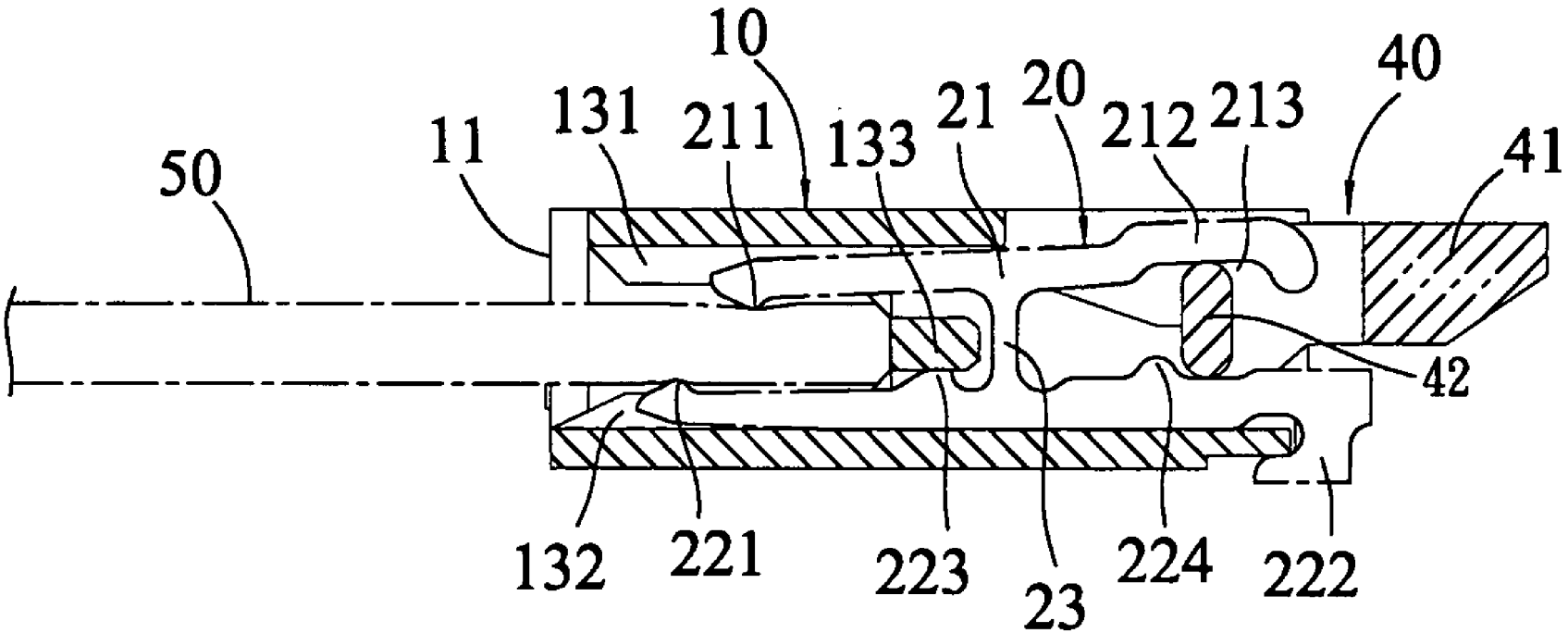
FIG. 6 is a schematic cross-sectional view of the present invention in a closed state.

Referring to FIGS. 5 and 6, there are the schematic cross-sectional views of the present invention in an open state and in a closed state. As shown in these drawings, the electrical connector of the present invention is used to hold a flexible flat cable 50. When the flip cover 40 is in the position for an open loop, one side edge of the rotatable portion 42 contacts the inner wall surface of the guiding groove 213 completely. The flexible flat cable 50 is inserted from the front opening 11 between the upper contact portion 211 and the lower contact portion 221, and the front end portions of the flexible flat cable 50 are propped against the positioning portions 133 to keep from extending thereinto. At this time, the flexible flat cable 50 can be exactly inserted and positioned. Then, the operating portion 41 of the flip cover 40 is pressed clockwise, and the flip cover 40 rotates clockwise to form a closed state and is positioned in the rear of the insulating body 10. When the flip cover 40 is in the position for a closed loop, the upper edges and lower edges of the rotatable portions 42 are propped against the inner wall surfaces of the guiding grooves 213 of the upper arms 21 and the surfaces of the lower arms 22 respectively. As a result, a propping force is applied upwardly against the guiding grooves 213 of the upper arms 21 by the rotatable portions 42 of the flip cover 40 such that the upper contact portions 211 disposed on the front ends of the upper arms 21 are propped downwards tightly against the flexible flat cable 50, thus providing a stable electrical connection between the flexible flat cable 50 and the terminals 20.

Furthermore, since the lower contact portion 221 of the terminal 20 is closer to the front opening 11 in comparison with the upper contact portion 211, when the flexible flat cable 50 is inserted between the upper contact portions 211 and the lower contact portions 221, the lower contact portions 221 would lift the bottom surface of the flexible flat cable 50 slightly upwardly to allow the top surface of the flexible flat cable 50 to be propped more toward the upper contact portions 211. The flexible flat cable 50 is held between the upper contact portions 211 and the lower contact portions 221 more securely, thus avoiding the release of the flexible flat cable 50.

Accordingly, the distance from the internal face of the guiding groove 213 to the top surface of the lower arm 22 is less than the height of the rotatable portion 42 in the position for a closed loop. Therefore, when the flip cover 40 is in the position for a closed loop, the ends of the upper arms 21 can be exactly lifted upwardly such that the upper contact portions 211 disposed on the front ends of the upper arms 21 are exactly propped downwards tightly against the flexible flat cable 50, thereby providing a stable electrical connection.

The preferred embodiments aforementioned are just for the purpose of illustration and not meant to limit the scope of the present invention. Any equivalent variation utilizing contents of the specification and drawings of the present invention, or directly/indirectly applying them in other related technical areas are still covered by the scope of present invention.

We claim:

1. An electrical connector for fastening a flexible flat cable comprising:

an insulating body having a front opening and a rear opening with an interior passageway extending therebetween, said insulating body having a plurality of terminal sockets;

a plurality of terminals respectively assembled within said plurality of terminal sockets, each of said plurality of terminals comprising:

an upper arm;

a lower arm in spaced parallel relation to said upper arm; and a linking arm connecting said upper arm to said lower arm in a center thereof, said upper arm having a contact portion at a front end thereof, said lower arm having a contact portion at a front end thereof, the contact portion being suitable for securing the flexible flat cable therebetween, said upper arm having a pivoting portion and a guide groove formed at a rear end thereof, said guide groove having a generally planar surface thereon;

a pair of shims respectively assembled on opposite sides of said insulating body; and a flip cover having a operating portion and rotatable portions, said flip cover having shaft portions respectively at opposite sides thereof, said shaft portions bearing on said pair of shims, said rotatable portion being respectively pivotally disposed within the guide grooves of the upper arms so as to allow said flip cover to rotate between an opening position and a closing position, said rotatable portions being received against said generally planar surface of the guide grooves when said flip cover is in the open position, said rotatable portions being propped against said generally planar surface of said guide groove of said upper arm and against said lower arm simultaneously when said flip cover is in said closed position so as to securely hold and position the flexible flat cable by the contact portions of said upper and lower arms.

2. The electrical connector of claim 1, wherein said shim has a propping portion disposed at a front end thereof, said shim having a flat plate portion at a rear end thereof, said flat plate portion having a height less than a height of the propping portion, the shaft portions of said flip cover bearing on the flat plate portions both in said open position and in said closed position.

3. The electrical connector of claim 1, wherein said lower arm of the terminal has a stop shoulder adjacent a front end of the guiding groove, the stop shoulders stopping in front of said rotatable portions when said flip cover is in said closed position so as to prevent said flip cover from slipping inwardly.

4. The electrical connector of claim 1, wherein the terminal socket of said insulating body has an upper socket and a lower socket which are correspondingly arranged, a positioning portion is disposed between said upper socket and said lower socket, and said lower arm of the terminal has a protruding portion corresponding to said positioning portion.

5. The electrical connector of claim 1, wherein said lower arm of the terminal has a soldering portion at said rear end thereof, said soldering portion extending beyond said insulating body to be suitable for soldering onto a circuit board.

6. The electrical connector of claim 1, wherein the rotatable portions of said flip cover are arranged at equal intervals and correspond to the guiding grooves of the terminals.

7. The electrical connector of claim 1, wherein said contact portion of said lower arm is closer to said front opening than said contact portion of said upper arm.

8. The electrical connector of claim 1, wherein a distance from an internal face of said guiding groove to a top surface of said lower arm is less than a height of the rotatable portion when said flip cover is in said closed position so as to lift the guiding grooves upwardly with the rotatable portions such that said contact portion of said upper arm is urged downwardly.

9. The electrical connector of claim 1, wherein said opposite sides of said insulating body respectively have through notches formed therein, said pair of shims are respectively received in said through notches.

10. The electrical connector of claim 9, wherein a hollowed-out cavity is disposed on a top surface of said insulating body adjacent to said rear opening, the flat plate portions of the shims extending beyond said through notches and outwardly below said hollowed-out cavity, said flip cover being rotatable within said hollowed-out cavity.

* * * * *